US007023399B2

(12) United States Patent
Zaretsky et al.

(10) Patent No.: US 7,023,399 B2
(45) Date of Patent: Apr. 4, 2006

(54) WINDOW ACCOUTREMENT

(76) Inventors: Abraham Max Zaretsky, 2119 Embassy Dr., West Palm Beach, FL (US) 33401; Carl Bernard Apfel, 44 Cocoanut Row, Palm Beach, FL (US) 33480

( * ) Notice: Subject to any disclaimer, the term of this patent is extended or adjusted under 35 U.S.C. 154(b) by 3 days.

(21) Appl. No.: 10/792,997

(22) Filed: Mar. 4, 2004

(65) Prior Publication Data

US 2005/0195122 A1 Sep. 8, 2005

(51) Int. Cl.
*H01Q 1/42* (2006.01)

(52) U.S. Cl. ..... 343/872; 343/878; 343/912

(58) Field of Classification Search ..... 343/702, 343/700 MS, 872, 913, 912, 842
See application file for complete search history.

(56) References Cited

U.S. PATENT DOCUMENTS

| | | | | |
|---|---|---|---|---|
| 5,526,010 | A | 6/1996 | Plunk | |
| 5,550,552 | A * | 8/1996 | Oxley | 343/702 |
| 5,707,033 | A | 1/1998 | Holt et al. | |
| 5,852,424 | A | 12/1998 | Reineck et al. | |
| 5,890,455 | A * | 4/1999 | Donchey | 119/484 |
| 5,961,092 | A | 10/1999 | Coffield | |
| 5,982,340 | A | 11/1999 | Troche | |
| 6,037,913 | A * | 3/2000 | Johnson | 343/882 |
| D456,387 | S | 4/2002 | Hwang | |
| 6,404,405 | B1 * | 6/2002 | Wanat | 343/892 |
| 6,407,709 | B1 | 6/2002 | Hanshew | |
| 6,421,019 | B1 | 7/2002 | Albertelli et al. | |
| 6,421,020 | B1 | 7/2002 | Chatzipetros et al. | |
| 6,441,799 | B1 | 8/2002 | Spaulding | |
| 6,496,138 | B1 | 12/2002 | Honma | |
| 6,509,876 | B1 * | 1/2003 | Jones et al. | 343/702 |
| 6,538,612 | B1 * | 3/2003 | King | 343/757 |
| 6,731,250 | B1 * | 5/2004 | Berman | 343/878 |

* cited by examiner

*Primary Examiner*—Trinh Vo Dinh
(74) *Attorney, Agent, or Firm*—Akerman Senterfitt

(57) ABSTRACT

A radio-frequency device holder can include a base support member for the radio-frequency device holder to be positioned on a window sash and panels forming a box-like structure above the support member. The panels can be designed to replicate a window air conditioner. The side accordion members can be designed to replicate air conditioner side accordion members.

13 Claims, 2 Drawing Sheets

WINDOW ACCOUTREMENT

BACKGROUND OF THE INVENTION

The invention relates to a holder for a satellite TV dish which can be conveniently used in a window of an apartment, house, or other habitable building.

A number of references disclose satellite dish holders, as for example, U.S. Pat. No. 5,852,424. As disclosed in FIGS. 4 and 4A of U.S. Pat. No. 5,852,424, a block-like building element 10 is utilized. Outer skin layers 12 may be constructed from material such as ABS, which is substantially transparent to electromagnetic waves.

U.S. Pat. No. 6,421,019 discloses an antenna deployment system for a vehicle which features a cabinet 12 and a platform 14 which holds the antenna assembly 20 mounted thereto.

U.S. Pat. No. 6,441,799 discloses a polyurethane foam concealment panel which is substantially radio-frequency (RF) transparent and which can be camouflaged by application of paint and other coatings to match the exterior surfaces of buildings.

U.S. Pat. No. 6,404,405 discloses a releasable mounting for a satellite dish antenna, with the mounting intended specifically for suspending a dish satellite outside of the window.

U.S. Pat. No. 6,496,138 discloses an electromagnetic wave radar device in which a mounting for the device serves to conceal the radar device from view.

U.S. Pat. No. 6,037,913 discloses a satellite dish mounting which can be used to direct the dish antenna in a variety of directions and can be used adjacent to a window.

Finally, U.S. Pat. No. 5,982,340 discloses a mounting system for mounting a satellite dish indoors, but which can be extended outdoors through a window opening.

While many of the references suggest ways to conceal a satellite dish, none of the references have the specificity of the subject application with respect to the use of a satellite dish in a window in a practical way.

For example, a number of the references previously discussed disclose structure for concealing satellite dishes, but such structure is as objectionable as the dishes themselves in that structure is created that is unusual and nonconforming to an apartment or house usage.

SUMMARY OF THE INVENTION

Accordingly, it is an object of the subject invention to provide a holder which conceals a radio-frequency (RF) device yet conceals such device in an acceptable and useful manner.

It is a further object of the subject invention to provide structure which can conceal a RF device, yet which is efficient and easy to use.

It is but another object of the subject invention to provide structure for concealing a RF device, yet providing structure which can be easily accessed by the user.

It is but one more object of the subject invention to provide a RF device holder which appears to be an air conditioner.

In accordance with the objects of the subject invention, a RF device holder is the subject of the present application, which holder is designed to, in all respects, appear to be an air conditioning unit. Under such circumstances, the holder can be used in windows of apartments, houses, or other structures, and from outward appearances will appear to be an air conditioning unit. The holder is easily accessible from inside the house by a simple catch mechanism which allows the back to be lowered and the RF device to be placed in the unit or removed therefrom.

The holder is surrounded by structure, which as in the case of a window air conditioner, creates a secure window treatment which will keep out elements and also serve to secure the window from unwanted entry.

Appropriate panels of the RF device holder are substantially transparent to electromagnetic waves, such that the reception of the RF device mounted or contained therein is not hindered. That is, the RF device can function in a manner that is acceptable for the intended use of the RF device. The RF device holder can be large enough so that the RF device is rotatable within the unit to permit acceptable reception.

BRIEF DESCRIPTION OF THE DRAWINGS

There are shown in the drawings, embodiments which are presently preferred, it being understood, however, that the invention is not limited to the precise arrangements and instrumentalities shown, wherein.

DETAILED DESCRIPTION

The present invention provides a solution for mounting and/or holding various radio-frequency (RF) devices. More particularly, the present invention provides an RF-friendly enclosure that can be used to mount or hold RF devices such as RF receivers and/or RF transceivers. For example, in accordance with the inventive arrangements disclosed herein, the present invention can be used to house any of a plurality of RF devices including, but not limited to, a cellular phone base station, a satellite dish, a two-way radio, a wireless access point, a base station for a conventional wireless telephone, or any other similar RF-based device.

Figure 1:
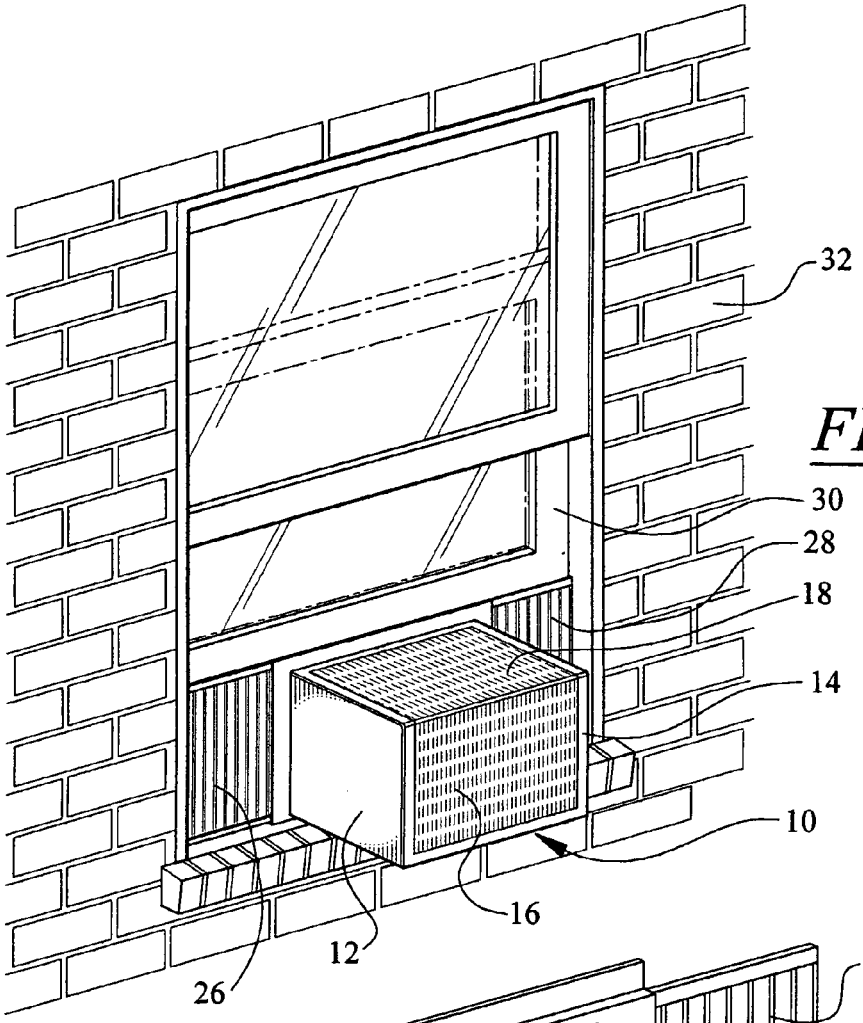
FIG. 1 shows an isometric view of a radio-frequency (RF) device holder inserted within a window in accordance with one embodiment of the present invention.

Accordingly, in one embodiment, the present invention can be implemented as a RF device enclosure or holder 10 as shown generally in FIG. 1 having side panels 12 and 14, end panel 16, and a top 18. The RF device holder 10 will be quickly recognized as being very similar to a window air conditioning unit. End and top panels 16 and 18 can be made of RF-friendly material or a material that is otherwise substantially transparent to electromagnetic waves so that a satellite dish or other RF-based device can function within the unit. In another embodiment, side panels 12 and 14 also can be RF-friendly as disclosed herein.

Figure 2:
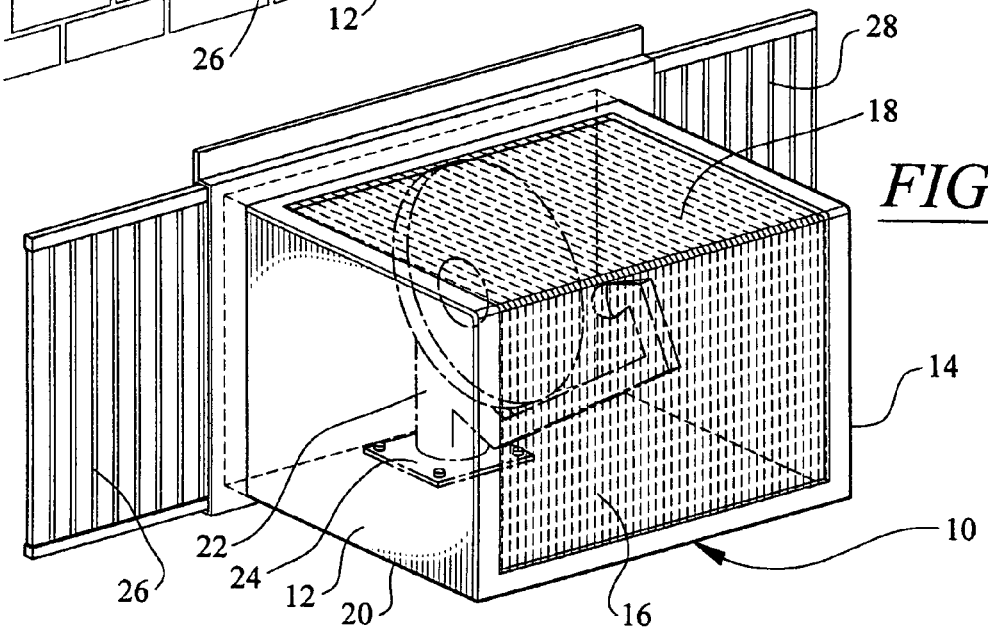
FIG. 2 discloses a close-up isometric view of the RF device holder of FIG. 1 showing the satellite dish in phantom within the unit in accordance with another embodiment of the present invention.

As seen in FIG. 2, the RF device holder 10 has a bottom 20 on which a satellite dish 22 is positioned on a satellite dish plate 24. As seen in FIGS. 1 and 2, accordion sides 26 and 28 are insertable below the window sash 30, which is part of an apartment or house siding 32 which is shown to be brick. With specific attention to FIG. 3, the windowsill 34 has a window receptacle, and which insert member 36 is positioned. The satellite plate 24 is secured to the bottom 20 of RF device holder 10 by screws 38 or another appropriate fastening mechanism.

Figure 3:
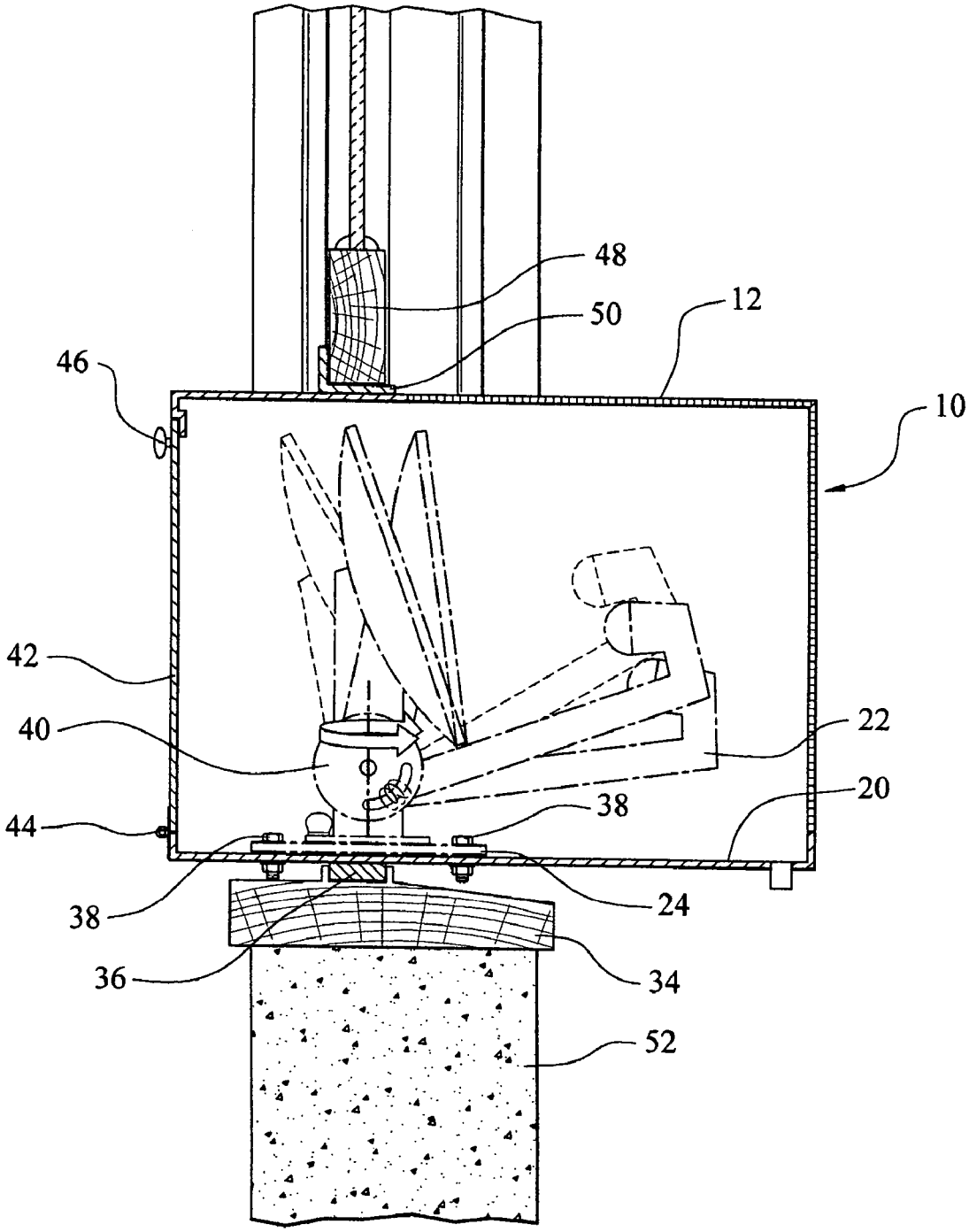
FIG. 3 is a side elevational cross-sectional view of the unit of FIG. 1 in accordance with yet another embodiment of the present invention.

With further reference to FIG. 3, the satellite dish 22 has a rotation swivel device 40 which enables the satellite dish 22 to be positioned in any of a variety of desirable positions. The holder 10 has a back member 42 with a lower hinge 44 and an upper clasp 46 which can be opened to insert or remove or otherwise adjust satellite dish 22. The window sash 48 is shown above with sash angle 50 resting against the top 12 of the RF device enclosure 10. Masonry structure 52 is shown below windowsill member 34.

As appreciated from FIG. 1, the RF device holder 10 for all intents and purposes has the appearance of an air conditioner, as both the holder itself and the surrounding structure, i.e., accordion sides 26 and 28, give the impression of being such a unit. As can be appreciated from FIG. 3, a satellite dish 22 can be quickly placed within the holder 10 to enable use of satellite dish 22. The back 42 of the holder 10 can be opened and dropped down to allow access to satellite dish 22.

Unlike prior references that disclose satellite dish holders, the present invention is very useful to enable a person to quickly utilize the inside of holder 10 by access through back panel 42. Notably, the back panel 42 can be perforated or vented, for example to allow electrical service into the holder 10 and/or to allow for ventilation of any electrical and/or RF components disposed within the holder 10.

The appearance as an air conditioning unit in the first instance enables the holder 10 to be utilized without attracting undue attention to lessen any potential problems of theft of satellite dish 22 or any other RF device contained therein. In addition, the present invention allows one to utilize an RF device without running afoul of building or home association rules and/or guidelines that disfavor the use or mounting of such devices.

While the present invention has been largely described with reference to a satellite dish, as noted, the present invention can be used as a holder for any of a variety of RF-devices whether receivers, transmitters, and/or transceivers. For example, the present invention can be used to mount a cellular phone base station, a satellite dish, a two-way radio, a wireless access point such as an 802.11 wireless access point, or a base station for communicating with one or more conventional indoor wireless telephones.

The various RF devices can be secured to mounting plates fashioned according to the particular dimensions of the RF device to be mounted and as described herein. In another embodiment, such RF devices can be placed within the holder 10 without any mounting plate, for example in those cases where the RF device is free-standing or self-supporting.

In another embodiment of the present invention, the holder 10 can include a short range wireless transmitter or transceiver (not shown). For example, the short range wireless transmitter or transceiver can be configured to communicate using any of the 802.11 family of wireless communications protocols. In another example, such a transmitter or transceiver can communicate over a 900 MHz and/or a 2.4 GHz wireless communication link, or variants thereof, as are commonly used by conventional wireless telephones and wireless telephone base stations.

Such a short range wireless transmitter or transceiver can be mounted to the back 42 or placed or otherwise secured within the holder 10. In such an embodiment, rather than extend cables from the RF device to other local devices such as televisions, cellular phones, computer systems, or other devices that may be communicatively linked with the RF device, signals received by the RF device supported by the holder 10 can be provided to the short range wireless transmitter or transceiver via a connecting wire or cable to be re-broadcast. Notably, the back 42 still can have one or more openings to allow for electrical service into the holder 10.

As noted, the holder 10 can be designed to keep out elements and also secure the window from unwanted entry. For example, the various components of the holder 10 that have exposure to the outside can be weatherized. Similarly, the holder 10, and any portions of the holder 10 that contact the building within which the holder 10 is to be installed, can be sealed such that elements are prevented from entering. The holder 10 also can be secured to the window from the inside such that the holder 10 cannot be removed without unlocking the securing mechanism.

It will be appreciated that the present invention may be adapted for utilization beyond the specific environments discussed herein. Accordingly, the present invention is not limited to the specific embodiments described herein, but is defined by the scope and spirit of the following claims.

What is claimed is:

1. A radio-frequency device holder comprising:

a bottom support member for the radio-frequency device holder to be positioned on a window sash;

panels forming a box-like structure above said bottom support member, which panels are designed to replicate a window air conditioner;

side accordion members designed to replicate air conditioner side accordion members; and wherein at least some of said panels are at least substantially radio-frequency transparent.

2. The device holder of claim 1, wherein the radio-frequency device holder is placed directly above the window sash.

3. The device holder of claim 1, wherein a radio-frequency device is rotatable within said radio-frequency device holder.

4. The device holder of claim 1, including a back member which can be opened.

5. The device holder of claim 4, wherein said back member is clasped at its top and hinged at its base to be opened to allow access into the holder.

6. The device holder of claim 1, wherein the radio-frequency device holder encloses a satellite dish.

7. The device holder of claim 1, wherein the radio-frequency device is selected from the group consisting of a cellular phone base station, a two-way radio, a wireless access point, and a base station for a conventional telephone.

8. The device holder of claim 1, further comprising a wireless transmitter configured to rebroadcast signals received from a radio-frequency device.

9. A multi-use holder for use in a window, comprising:

a bottom support panel;

two side panels;

an end panel;

a top panel;

a back panel which is operable to allow placement therein of a radio-frequency device;

wherein said bottom support panel, said side panels, said end panel, said top panel and said back panel form an enclosure mountable to a building for holding a radio-frequency device; and wherein at least a portion of at least one said bottom support panel, said side panels, said end panel, said top panel or said back panel is radio-frequency transparent.

10. The holder of claim 9, wherein the radio-frequency device is a satellite dish.

11. The holder of claim 9, wherein the radio-frequency device is selected from the group consisting of a cellular phone base station, a two-way radio, a wireless access point, and a base station for a conventional telephone.

12. The holder of claim 9, wherein the end and top panels are substantially radio-frequency transparent.

13. The holder of claim 9, wherein the back panel is perforated.

* * * * *